United States Patent [19]

Bruget

[11] 3,999,560

[45] * Dec. 28, 1976

[54] PIPE SMOKER'S IMPROVED COMBINATION TOOL

[76] Inventor: Bernard C. Bruget, 313 E. Catalina, Phoenix, Ariz. 85012

[ * ] Notice: The portion of the term of this patent subsequent to Aug. 20, 1991, has been disclaimed.

[22] Filed: June 2, 1975

[21] Appl. No.: 583,116

[52] U.S. Cl. ..... 31/243

[51] Int. Cl.[2] ..... A24F 9/02

[58] Field of Search ..... 131/177, 184 R, 184 B, 131/188, 170, 192, 243, 244, 245, 246, 247

[56] References Cited

UNITED STATES PATENTS

| | | | |
|---|---|---|---|
| 2,049,298 | 7/1936 | Jung | 131/247 |
| 2,503,501 | 4/1950 | Lutz | 131/247 X |
| 3,830,243 | 8/1974 | Bruget | 131/243 |
| 3,890,982 | 6/1975 | Bruget | 131/247 X |

*Primary Examiner*—Robert W. Michell
*Assistant Examiner*—V. Millin
*Attorney, Agent, or Firm*—Don J. Flickinger

[57] ABSTRACT

A first tamping disc has an arm extending generally perpendicular from the face thereof. An elongate shaft having first and second ends carries a radial disc proximate the second end thereof. The arm movably supports the elongate shaft intermediate the first end and the radial disc. In one embodiment the shaft is slidably supported by the arm and may be withdrawn therefrom. In an alternate embodiment the shaft is heatedly affixed to the free end of the arm.

7 Claims, 9 Drawing Figures

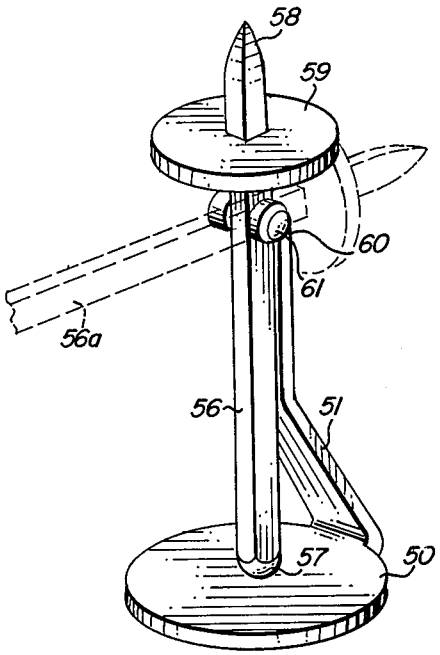
FIG-7
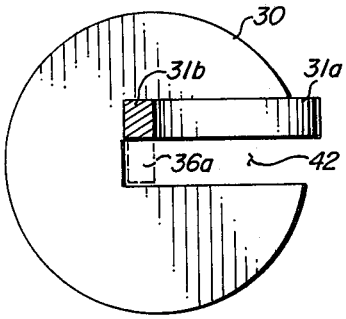
FIG-6
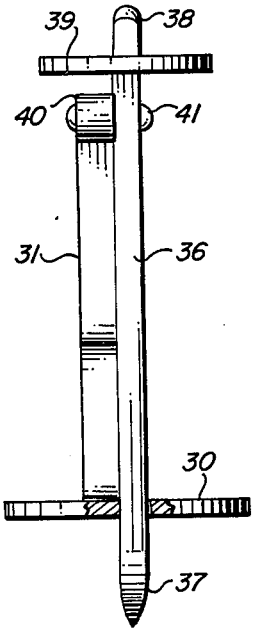
FIG-5
FIG-8
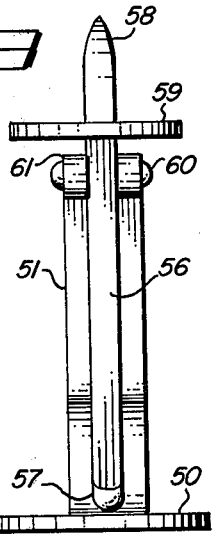
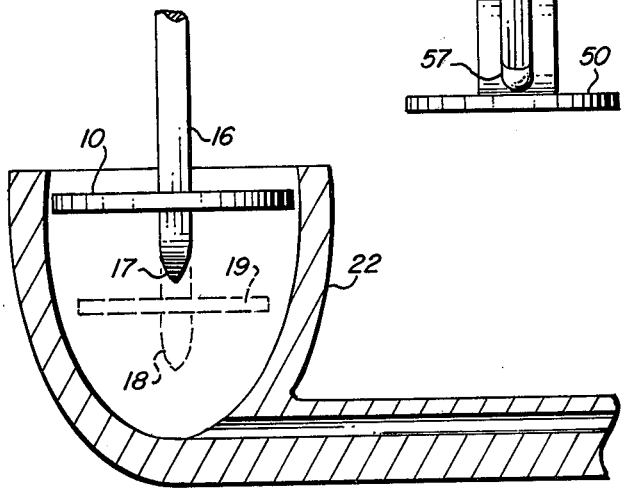
FIG-9

PIPE SMOKER'S IMPROVED COMBINATION TOOL

This invention relates to pipe smoker's accesssories.

More particularly the invention concerns a pipe smoker's combination tool having implements for tamping and aerating tobacco and for cleaning the stem and bowl of a pipe.

In a further aspect the instant invention concerns an improved multi-purpose pipe smoker's tool which is readily collapsed to a compact size for convenient storage.

It is well known that the pipe smoker depends upon various accessories to attend to his pipe while smoking and between smoking. These accessories include devices for tamping tobacco within the bowl, aerating the surface layer of tobacco while smoking and cleaning and picking dross and residue from the interior of the bowl and the stem. Considering the pipe smoker and the various ritualistic chores incidental to smoking the pipe such accessories are generally believed to be essential.

The prior art is replete with various accessories for the pipe smoker. An understanding of such devices can be had by referring to the current inventor's issued U.S. Pat. No. 3,830,243, entitled "PIPE SMOKER'S TOOL" and the current inventor's co-pending patent application Ser. No. 514,597, entitled "PIPE SMOKER'S FOLDING COMBINATION TOOL" now issued as U.S. Pat. No. 3,890,982. The devices disclosed therein are combination tools which perform several chores and represent a substantial improvement over the prior art. However, further research, experimentation and development has revealed that even greater convenience and utility can be embodied in a combination tool.

Accordingly, it is a principal object of the present invention to provide an improved tool to assist the pipe smoker.

Another object of the invention is the provision of a pipe smoker's improved combination tool having several implements for accomplishing various tasks.

Still another object of the present invention is to provide a pipe tool that is useful both during smoking and while cleaning the pipe.

Yet another object of the instant invention is to provide a pipe smoker's tool having a combination of implements which are used individually or in combination to perform single or simultaneous functions.

A further object of the invention is the provision of a pipe smoker's improved combination tool of the above type in which certain implements thereof are extended for use and the device is collapsed for compact and convenient stowage.

Briefly, to achieve the desired objectives of the present invention in accordance with a preferred embodiment thereof, provided is a first tamping disc sized to be inserted into a pipe hole and having an arm extending generally perpendicular from a face thereof. Also provided is an elongate shaft having first and second ends with a second tamping disc radially carried by the shaft proximate the second end. The shaft is movably supported by the arm intermediate the first end and the second tamping disc. In accordance with one embodiment the shaft is slidably and removably supported by the arm for removal of the shaft for use as a pick in cleaning the pipe. As a modification to the instant embodiment the arm slidably supports and alignes the shaft for extending the first end thereof through an aperture within the first tamping disc. In this configuration tobacco may be simultaneously tamped and aerated to a predetermined depth.

In an alternately preferred embodiment the shaft is hingedly affixed to the free end of the arm. In the folded position the shaft rests against the arm with the first end of the shaft directed towards the first tamping disc. In a modification thereof the disc includes an elongate radial aperture extending inwardly from the edge thereof and the length of the shaft is extended to be received through the aperture. Singular and combination functions are performed similar to the embodiment previously described.

In either of the foregoing embodiments and the modifications thereof the second or auxiliary tamping disc provides a finger rest while manipulating the first tamping disc or utilizing the other elements of the tool. When of a smaller size than the first tamping disc the second tamping disc provides compacting capabilities that otherwise might be inaccessible to the first tamping disc.

The foregoing and further and more specific objects and advantages of the present invention will become readily apparent to those skilled in the art from the following detailed description of the preferred embodiments thereof taken in conjunction with the drawings in which:

FIG. 5 is an elevational view of the device of FIG. 4;

FIG. 6 is a horizontal, sectional view taken along the line 6—6 of FIG. 5;

FIG. 7 is a perspective view of an alternately preferred embodiment of the pipe smoker's combination tool of the present invention;

FIG. 8 is an elevational view of the device of FIG. 7; and

FIG. 9 is a vertical sectional view of a typical pipe bowl and showing the use of different tamping tools of the present invention therein for comparative purposes.

Figure 1:
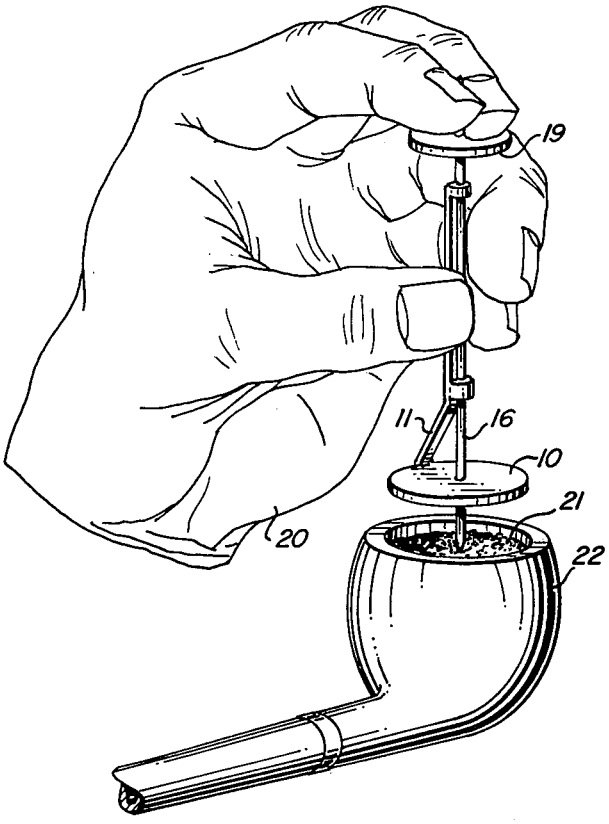
FIG. 1 is a perspective view of a preferred embodiment of the improved combination pipe tool of the present invention as it might appear during use.
Figure 2:
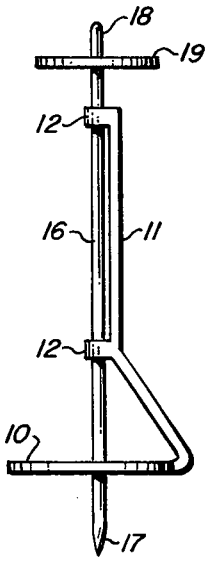
FIG. 2 is an elevational view of the embodiment of the invention as shown in FIG. 1.
Figure 3:
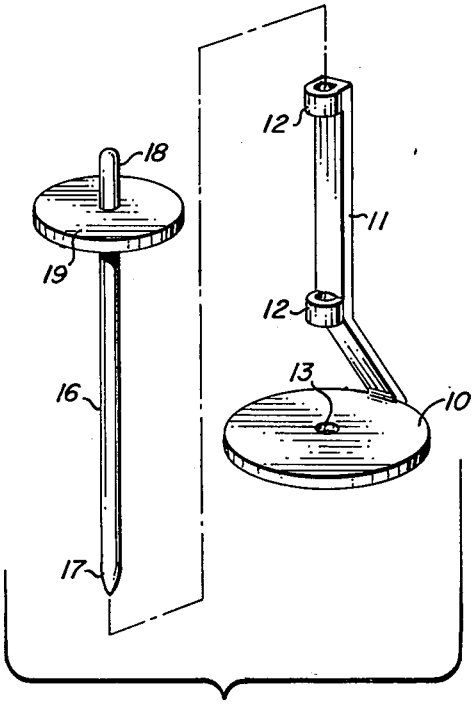
FIG. 3 is an exploded perspective view of the device of FIG. 2.

Turning now to the drawings in which the same reference numerals indicate corresponding elements throughout the several views attention is first directed to FIGS. 1 – 3 which illustrate a pipe smoker's improved combination tool of the present invention having a first tamping disc 10 having an arm 11 generally perpendicular to the face of disc 10. Guides 12 are carried by arm 11 in substantial alignment with the aperture 13 extending through disc 10. An elongate shaft 16 having first end 17 and second end 18 is slidably supported within guides 12. A second tamping disc 19 is radially carried by shaft 16 proximate second end 18 thereof.

As specifically seen in FIG. 1 radial tamping disc 19 provides a rest for the index and middle fingers of the smoker's hand 20 while the thumb and remaining fingers grasp arm 11 and shaft 16. In this position the smoker may employ disc 10 to tamp tobacco 21 within pipe bowl 22 or alternately with a short reciprocal motion utilize the first end 17 of shaft 16 to aerate tobacco 21. First end 17 of shaft 16 may be extended a predetermined distance below tamping disc 10 for aerating the tobacco to a desired depth or retracted to facilitate only tamping the tobacco. Also, the smoker may firmly grasp second tamping disc 19 withdraw shaft 16 from guide 12 to utilize first end 17 as a pick for removing dross from the heel of the bowl or removing residue from the stem of the pipe. Further, utility of second tamping disc 19 will be described presently.

Figure 4:
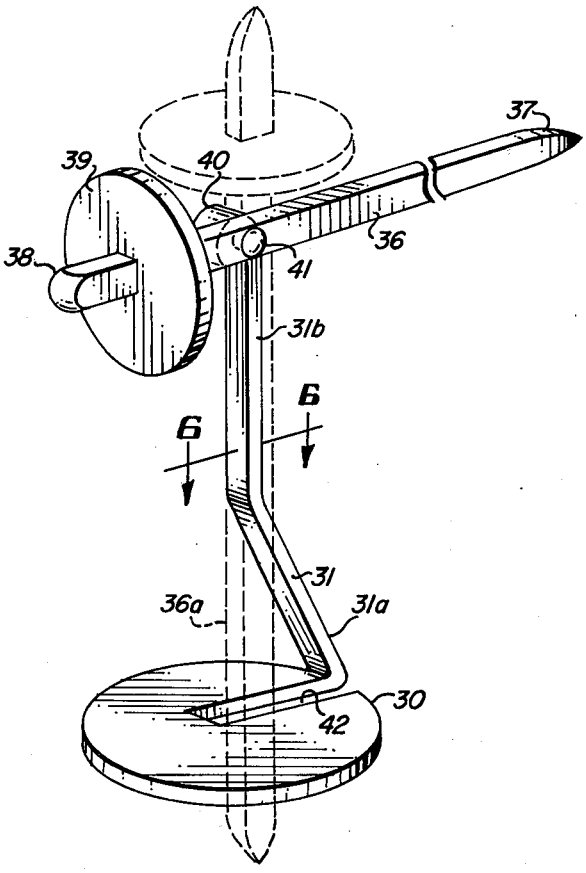
FIG. 4 is a perspective view of an alternately preferred embodiment of a pipe tool constructed in accordance with the teachings of the present invention.

Illustrated in FIGS. 4 – 6 is an alternately preferred embodiment of the present invention constructed in accordance with the teachings thereof and similar to the device of FIGS. 1 – 3 includes first tamping disc 30 having arm 31 extending generally perpendicular therefrom. Also provided in the instant embodiment is elongate shaft having first and second end 37 and 38, respectively. Second tamping disc 39 is radially carried by shaft 36 proximate second end 38 thereof. Shaft 36 is hingedly affixed intermediate first end 37 and second tamping disc 39 to free end 40 of arm 31 by pin 41.

Disc 30 has an elongate aperture or slit 42 extending radially inward from the edge thereof which is sized to receive shaft 36 therethough when the shaft is pivoted downwardly as illustrated in dashed line position 36A. The shaft as seen at 36A passses through the center of disc 30. To facilitate the central alignment of shaft 36 through disc 30 arm 31 has an inwardly directed segment 31A and a vertical segment 31B.

The extension of shaft 36 when in position 36A below disc 30 is clearly viewed in FIG. 5. In this position the tool is used for simultaneously tamping and aerating tobacco within the bowl of the pipe. It is seen that there is a greater distance from first disc 30 to first end 37 of shaft 36 than from second disc 39 to second end 38 of shaft 36. With this arrangement a depth of aeration performed simultaneously with tamping is a pre-determined variable depending on whether the tamping is accomplished with disc 30 or disc 39. To perform tamping and aerating as independent functions shaft 36 is moved to the angularly displaced solid line position as noted in FIG. 4. The angular position of shaft 36 is also preferred when the shaft is used for picking and scraping residue and draws from the pipe bowl or cleaning the pipe stem.

FIGS. 7 and 8 depict an alternately preferred embodiment of the invention having a first disc 50 and an arm 51 extending generally upward therefrom and a shaft 56 generally similar to the embodiment described in connection with FIGS. 4 – 6. However, the upper free end 60 of arm 51 is bifurcated to receive shaft 56 therebetween. Bifurcated upper end 60 and shaft 56 are pivotally connected by a pin 61. Shaft 56 similar to the earlier described embodiments includes first end 57 and second end 58 and radially carries second disc 59 proximate second end 58.

In the instant embodiment shaft 56 is shorter than shaft 36 of the embodiment of FIG. 4 and disc 50 does not include elongate aperture 42 as does disc 30. Shaft 56 therefore in the forward position as illustrated terminates above disc 50. Shaft 56 is rotatable relative arm 51 to dashed line position 56A. It will be appreciated, therefore, that tamping is accomplished with disc 50, aerating by shaft 56 in the position shown at 56A and simultaneous tamping and aerating with disc 59 and second end 58. The position of the shaft as shown at 56A also facilitates cleaning the pipe.

Further utility had by the instant invention particularly attributed to the unique feature of providing 2 tamping discs is clearly illustrated in FIG. 9. For purposes of illustration the particular embodiment of FIGS. 1 – 3 is used in FIG. 9; however, it is to be understood that the description thereof is exemplary of the other preferred embodiment as herein before described. Pipe bowls as is generally represented by pipe bowl 22 are commonly smaller at the bottom thereof than at the top. First disc 10 as seen in solid outline is used for tamping when the bowl is full or nearly full of tobacco. Concurrent aeration is performed by that portion of shaft 16 extending below disc 10. As seen in dashed outline disc 19 is substantially smaller than disc 10 and shaft 16 extends only a short distance beyond to facilitate tamping and aerating near the lower portion of bowl 22.

Various modifications and changes to the embodiments herein chosen for purposes of illustration will readily occur to those skilled in the art. For example, referring specifically to the embodiment of FIGS. 1 – 3 it is immediately apparent that aperture 13 may be eliminated and shaft 16 shortened to provide an embodiment similar to that illustrated in FIGS. 7 and 8. Alternately, second disc 19 may be placed at second end 18 whereby tamping only is afforded by disc 19. Further, in accordance with the preference of individual smokers the shafts may include blunt, chissel or spiral pointed ends. Similarly, the arm may be variously bent such that the shaft may extend through the first tamping disc at any desired location. To retard movement between the elements, particularly in the hinged embodiments mating serrated faces or waffled washers may be used.

Having fully described and disclosed the present invention and the preferred embodiments thereof in such clear and concise terms as to enable those skilled in the art to understand and practice the same, the invention claimed is:

1. A pipe smoker's improved combination tool for tamping tobacco within the bowl of a smoker's pipe, for aerating said tobacco, and for picking and cleaning the stem and bowl of said pipe; said improved tool comprising;

a. a first tamping disc sized to be inserted into a pipe bowl;

b. an arm having a first end fixed to said first tamping disc and a free second end and extending generally perpendicular at the face of said first tamping disc;

c. an elongate shaft having first and second ends and supported by said arm in a position normally perpendicular to said first tamping disc whereby said first end of said shaft is directed toward said first disc; and d. a second tamping disc radially carried by said shaft proximate the second end thereof said first and said second tamping disc being of different diameters whereby tobacco can be tamped within different sized pipe bowls.

2. The smoker's combination tool of claim 1, wherein said elongate shaft is slidably and removably carried by said arm.

3. The smoker's combination tool of claim 2, further including means defining an aperture in said first tamping disc for receiving said first end of said elongate shaft therethrough.

4. The smoker's improved combination tool of claim 1, wherein said elongate shaft is hingedly affixed to the free end of said area intermediate said first end of said elongate shaft and said second tamping disc.

5. The smoker's improved combination tool of claim 4, further including means defining an elongate aperture extending radially inward from the edge of said first tamping disc and sized to receive said first end of said elongate shaft therethrough.

6. The smoker's improved combination tool of claim 1, wherein said second tamping disc is diametrically smaller than said first tamping disc.

7. The smoker's improved combination tool of claim 1, wherein said second end of said elongate shaft extends beyond said tamping disc.

* * * * *